United States Patent [19]

Cavalli

[11] Patent Number: 4,696,074

[45] Date of Patent: Sep. 29, 1987

[54] MULTI-PURPOSE HOUSEHOLD APPLIANCE PARTICULARLY FOR CLEANING FLOORS, CARPETS, LAID CARPETINGS, AND THE LIKE

[76] Inventor: Alfredo Cavalli, Via Galileo Galilei, 9-20060 Pessano Con Bornago (Milan), Italy

[21] Appl. No.: 799,772

[22] Filed: Nov. 21, 1985

[30] Foreign Application Priority Data

Nov. 21, 1984 [IT] Italy ..... 23851/84[U]

[51] Int. Cl.[4] ..... A44B 11/00

[52] U.S. Cl. ..... 15/321; 15/322

[58] Field of Search ..... 15/321, 322, 320, 353

[56] References Cited

U.S. PATENT DOCUMENTS

| | | | |
|---|---|---|---|
| 1,669,077 | 5/1928 | Brewer | 15/321 X |
| 3,436,787 | 4/1969 | Wisdom | 15/321 |
| 3,439,374 | 4/1969 | Wisdom | 15/322 X |
| 3,974,541 | 8/1976 | Silvis | 13/320 |
| 4,093,309 | 6/1978 | Sundheim | 15/320 |
| 4,167,799 | 9/1979 | Webb | 15/320 |
| 4,308,636 | 1/1982 | Davis | 15/321 |

*Primary Examiner*—Ronald Feldbaum

*Attorney, Agent, or Firm*—Sughrue, Mion, Zinn, Macpeak, and Seas

[57] ABSTRACT

A household appliance for cleaning generic surfaces comprises a wheel mounted working head incorporating a steam generator and an air liquid part in communication with a suction conduit. This household appliance is particularly useful for cleaning floors, carpets, and the like.

1 Claim, 4 Drawing Figures

MULTI-PURPOSE HOUSEHOLD APPLIANCE PARTICULARLY FOR CLEANING FLOORS, CARPETS, LAID CARPETINGS, AND THE LIKE

DESCRIPTION

The present invention relates to a multi-purpose household appliance for generally cleaning washable surfaces, which is particularly useful for cleaning floors, carpets and laid carpetings, and the like.

It is well known that floor cleaning constitutes one of the most demanding operations at household level, and that the difficulty of an effective and more than satisfactory cleaning is aggravated by the presence of wall-to-wall carpetings and the like.

For such an operation, such household appliances as vacuum cleaners, carpet sweepers, electric brooms, etc. have been made available, and in relatively recent times, the so-called carpeting washers, wherein a working head incorporates a device for dispensing water in the form of more less powerful and more or less atomized jets, possibly associated with a vacuum device and a collecting vessel.

Again at household level, the use has been proposed for some time of boilers for generating steam to be supplied to different utensils-dispensers, through which the steam is directed to washable surfaces such as, in particular and almost exclusively, glazed surfaces, tile-covered surfaces, curtains, and the like.

But besides the recognized cleaning effect of steam, especially if dry, the use of boilers for generating steam involves a whole series of just as well recognized drawbacks, such as:

relatively long wait times, for bringing the boiler to steady state;

high power consumption to prevent the formation of condensates along the conduits connecting the utensils-dispensers to the boiler;

reduced endurance;

hazard from the presence of steam under pressure (even though safety devices are employed); this hazard is then particularly enhanced at the time of topping up or refilling the boiler with cold water;

bulk and poor usability.

The main object of this invention is to provide a multi-purpose household appliance having such structural and functional characteristics as to be particularly useful and effective for cleaning floors, carpets, and laid carpetings, and more generally, washable surfaces, overcoming all of the drawbacks mentioned above in connection with the prior art.

This and other objects which will be apparent from the description to follow, are achieved by a household appliance for cleaning floors which, according to the invention, is characterized in that it comprises a working head incorporating:

a steam generator in liquid communication, on the one side, with a water supply conduit, and on the other side, with a steam dispenser, an air-liquid suction port opening substantially in the same direction as said steam dispenser and being in communication with a suction conduit.

Advantageously and in accordance with a feature of this invention, the steam generator is of the type comprising at least two electrically heated metal plates, a vaporizing chamber in liquid communication with said water supply conduit, and a steam path formed between said plates and being in fluid communication, on the one side, with said vaporizing chamber, and on the other side, with said steam dispenser.

In accordance with a further feature of the present invention, the steam dispenser comprises a plurality of holes formed in at least one portion of one of said metal plates.

Advantageously and in accordance with a preferred embodiment, the household appliance of this invention is associated with a set comprising, preferably in a unitary body of box-type construction, a water reservoir in liquid communication with said steam generator through a pump and a delivery conduit, a vacuum assembly in fluid communication with said suction port, and a tank for collecting the material drawn up by said assembly through said suction port.

Further features and advantages of the invention will be more clearly understood from the following description of an exemplary embodiment thereof, given herein with reference to the accompanying, merely illustrative drawings, where:

Figure 1:
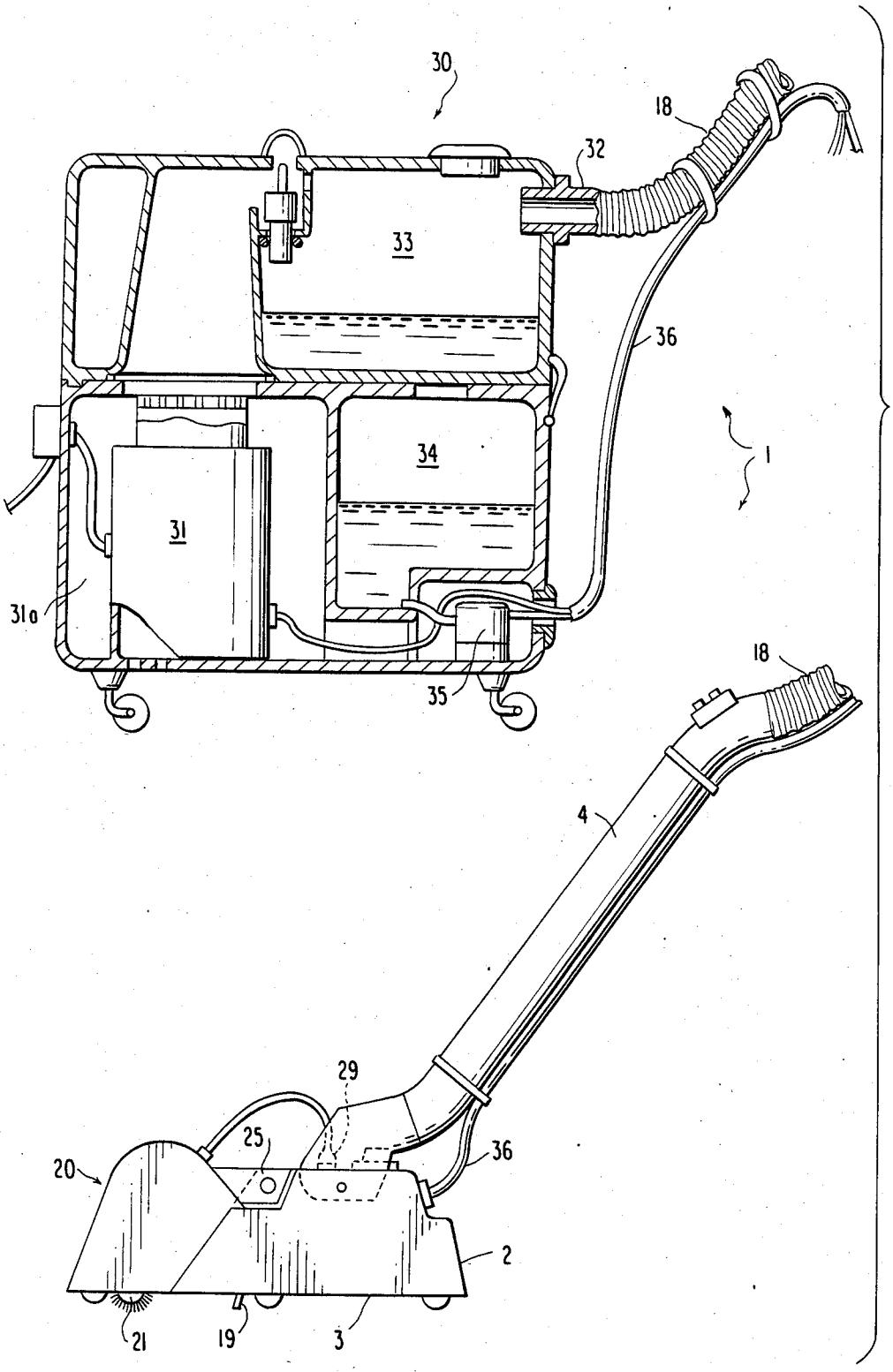
FIG. 1 shows diagrammatically and in cross-section a household appliance according to the invention.
Figure 2:
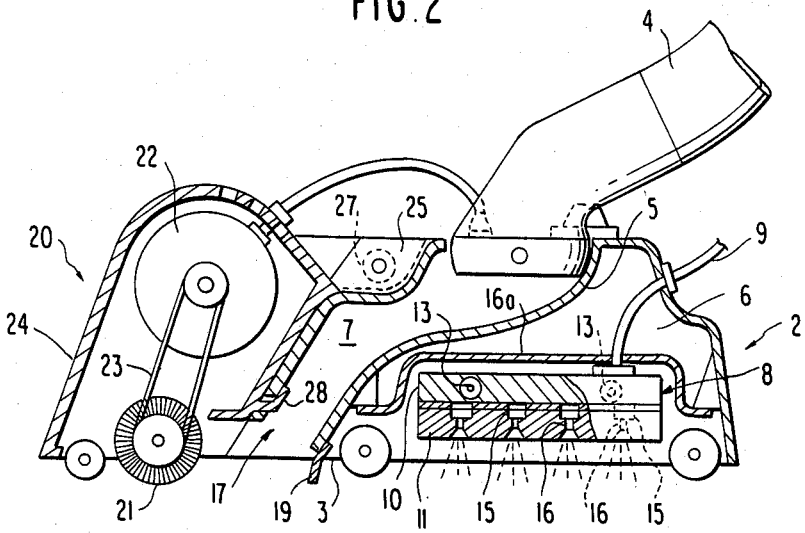
FIG. 2 is a longitudinal section through the working head of the household appliance of FIG. 1.
Figure 3:
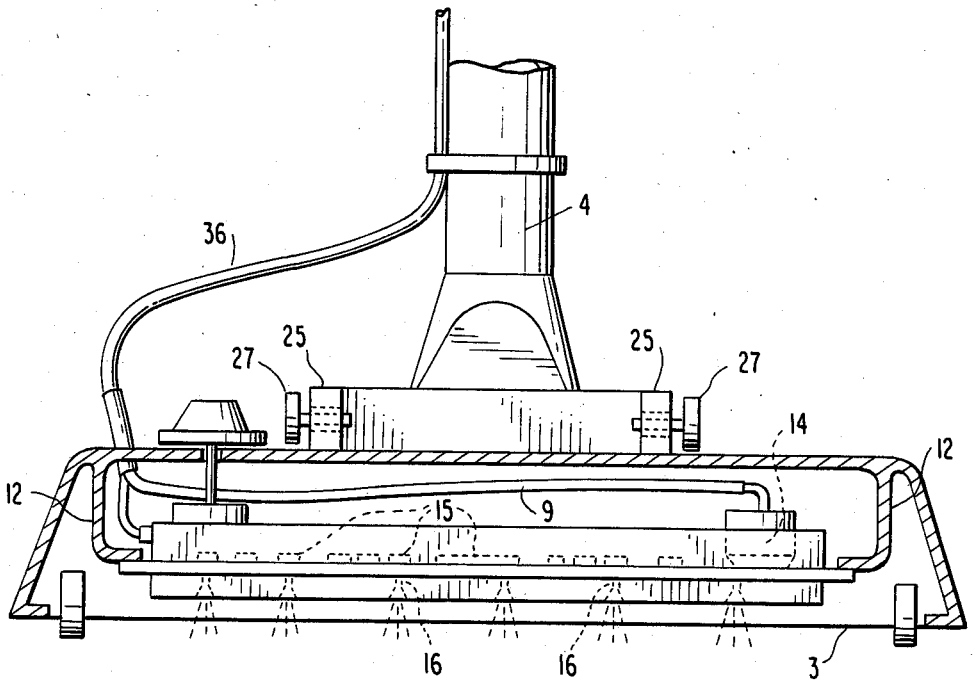
FIG. 3 is a cross-sectional view of the same working head as in FIG. 2.
Figure 4:
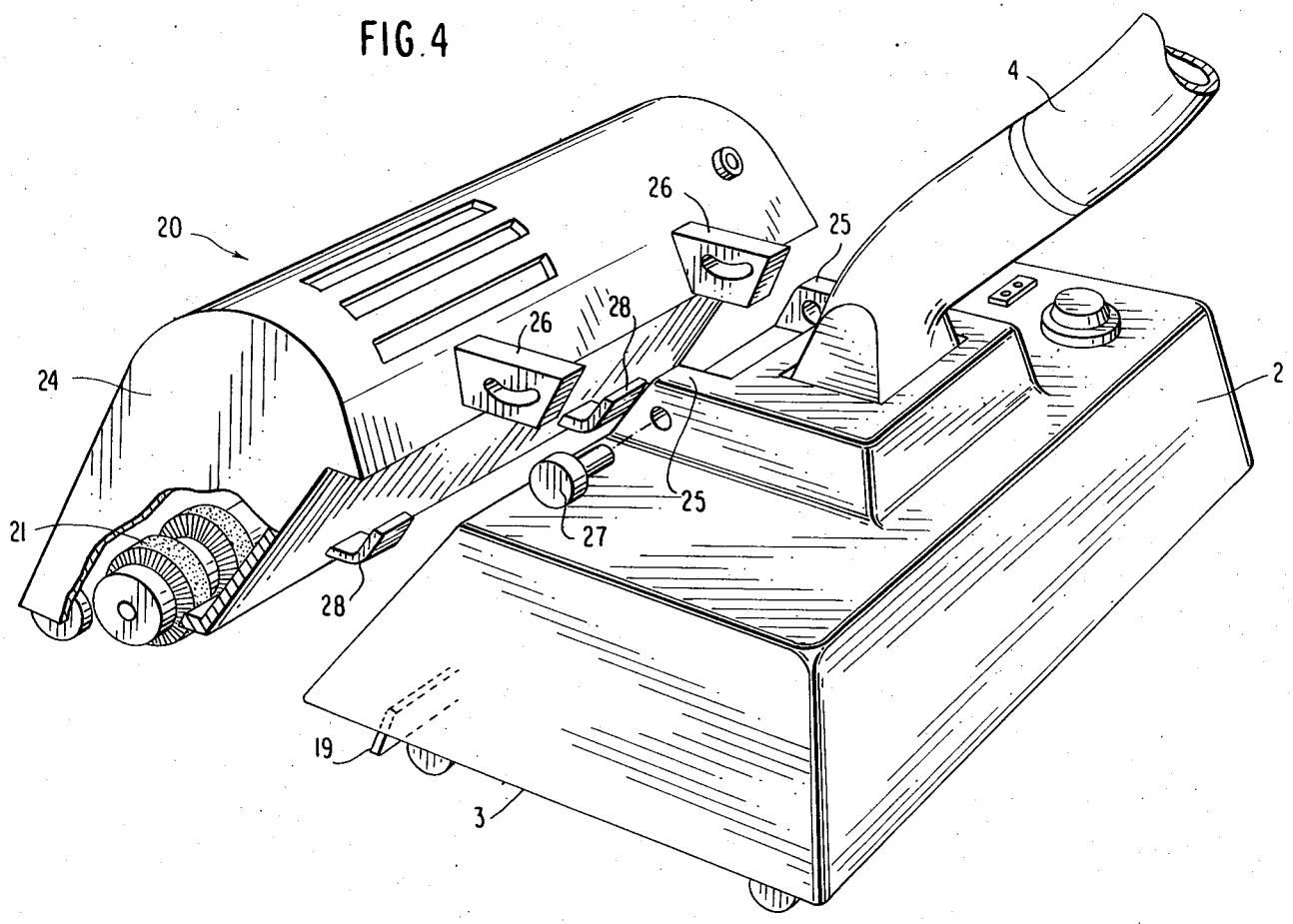
FIG. 4 shows in perspective and to an enlarged scale a household appliance according to this invention.

With reference to the aforesaid figures, at 1 there is indicated a household appliance according to the invention utilized for cleaning floors, carpets and laid carpetings, and the like, which comprises essentially a working head 2, of box-type load-bearing construction, having a conventionally wheel-mounted bade 3, thereby said household appliance can be easily driven across a floor to be cleaned through an appropriate elongate handle handgrip 4. The wheel-mounted base 3 is of preference fully open for the reasons which will become apparent hereinafter.

A shaped wall 5 supported on and extending within said working head 2 defines two contiguous chambers 6,7. In the chamber 6, there is supported a steam generator generally indicated at 8, in liquid communication with a water supply conduit 9. In particular said steam generator 8 is of the type comprising two metal plates 10,11 which are associated in superimposed relationship and carried conventionally on a plurality of brackets 12 formed integrally with said box-type head 2, two or more electric resistors 13, incorporated to one of said plates, preferably to the top plate 10. A vaporizing chamber 14 is formed in the top plate 10 and is, on the one side, in liquid communication with said conduit 9, and on the other side, in fluid communication with a canalization 15 and is in communication with a steam dispenser which is composed of a plurality of holes 16 formed in the bottom plate 11. The aforesaid steam generator is covered at the top by a thermally insulative shroud 16*a*.

The chamber 7 forms a vacuum chamber for which the suction port is indicated at 17, as defined in the open base 3 of said working head 2. The vacuum chamber 7 is in fluid communication with a suction conduit 18, a portion whereof is advantageously composed of the elongate handle 4, envisaged of tubular construction.

To the free edge of the shaped wall 5, there is secured removably in a manner known per se, a flexible strip 19 spanning the full length of the suction port 17 and being utilized to form a screen between said suction port and the plural steam dispensing holes 16, so as to prevent the steam being dispensed from being drawn up prior to contacting the surface to be cleaned.

Of course, this strip 19 could be designed differently to also perform a cleaning function of its own across the wall being treated; for example, it could be provided with a free end configured as a brush or comb or the like.

The box-type head 2 is also provided with quick connection means, explained hereinafter, for operatively and removably hooking on an accessory cleaning device 20, known per se. As an example, and preferably, this device is a conventional carpet sweeper whose brush 21 is driven by an electric motor 22 through a belt drive 23, all these components being enclosed within a metal shroud 24. Again by way of example, the aforesaid quick connection means comprise one or more small ears 25 attached to or formed integrally with the box-type head 2 and being adapted for coupling with plate-like brackets 26, attached to the ears 25 such as through pins 27. The accessory device coupling is completed with projecting brackets 28 thereof engaging in appropriate slots, not shown, formed in the box-type head 2. On the box-type head there is further provided an electric connection member 29 for connection to the electric motor 22.

With reference to FIG. 1, the household appliance of this invention is used preferably in association with a set 30 including a wheel-mounted box-type body wherein there is supported on conventional means a suction member 31 in fluid communication with said suction conduit 18, through a pipe fitting 32 attached to a wall of said box-type body. Between the suction member 31 and the pipe fitting 32, there is formed a chamber 33 serving as a collecting tank for the material drawn up, which chamber is positively isolated from the compartment 31*a* accommodating said suction member 31. Also formed within the box-type body 30 is a water reservoir 34, accessible from the outside, whence a pump 35 draws water to supply it to the aforesaid conduit 9.

It should be noted that the conduit 9 for supplying water from the reservoir 34 to the steam generator 8, and any electrical cables provided, are advantageously bundled together in a common sleeve 36, associated by conventional means with the suction conduit 18.

The advantages afforded by the household appliance of this invention are basically a significant saving in power as brought about by the provision of the steam generator directly within the working head, thereby avoiding the cited steam condensation phenomena in connection with the prior art, the absence of boilers for generating steam under pressure; extended endurance owing both to the large capacity of the water reservoir, which is structurally independent of the working head 2 and which, as such, may be easily refilled without any risks for the operator; extreme usability of the appliance, and not least, the possibility of associating therewith a plurality of cleaning accessories for the achievement of optimum results in the different cases where the appliance of this invention may be used.

I claim:

1. A household appliance for cleaning substantially flat surfaces such as floors, carpets and the like comprising a working head, a handle connected to said working head, a steam generator mounted in said working head in communication with a water supply conduit and a vacuum chamber having an air-liquid suction port located in said working head in communication with a vacuum conduit comprising a portion of said handle, said steam generator being comprised of two superimposed metal plates having electrical heating means incorporated in at least one of said plates, a vaporizing chamber disposed in one of said plates in communication with said water supply conduit, steam passages located between said plates in communication with said vaporizing chamber and a plurality of holes extending through the other of said plates in communication with said steam passages for dispensing steam outwardly of said head adjacent said suction port.

* * * * *